US005786563A

United States Patent [19]

Tiburzi

[11] Patent Number: 5,786,563

[45] Date of Patent: Jul. 28, 1998

[54] MODULAR ICE AND SNOW REMOVAL PANELS WITH GUTTER EXCLUSION VALVE

[76] Inventor: Anita Tiburzi, 242 Millerton Rd., Sharon, Conn. 06069-0723

[21] Appl. No.: 683,261

[22] Filed: Jul. 18, 1996

[51] Int. Cl.[6] ..... H05B 1/00; E04D 13/00

[52] U.S. Cl. ..... 219/213; 52/24

[58] Field of Search ..... 219/200, 201, 219/213, 509, 512, 514; 52/24, 25, 26, 57

[56] References Cited

U.S. PATENT DOCUMENTS

| | | | |
|---|---|---|---|
| 3,129,316 | 4/1964 | Glass et al. | 219/213 |
| 3,521,029 | 7/1970 | Toyooka et al. | 219/213 |
| 3,691,343 | 9/1972 | Norman | 219/213 |
| 3,784,783 | 1/1974 | Gray | 219/213 |
| 4,110,597 | 8/1978 | Elmore | 219/200 |
| 4,401,880 | 8/1983 | Eizenhoefer | 219/213 |
| 4,769,526 | 9/1988 | Taouil | 219/213 |
| 5,391,858 | 2/1995 | Tourangeau et al. | 219/213 |

*Primary Examiner*—Teresa J. Walberg
*Assistant Examiner*—Sam Paik
*Attorney, Agent, or Firm*—Gottlieb, Rackman & Reisman

[57] ABSTRACT

Modular roofing panels for removing snow and ice from the edge of a roof are interconnected. A defective panel or one damaged by severe weather can be replaced without incurring extensive wiring difficulty. An electrically operated valve element at the edge of the panels can selectively guide water from the roof either over the gutter thus effectively bypassing it, or into the gutter.

20 Claims, 10 Drawing Sheets

MODULAR ICE AND SNOW REMOVAL PANELS WITH GUTTER EXCLUSION VALVE

FIELD OF THE INVENTION

The present invention relates to modular interconnected roofing panels for removing snow and ice from the edge of a roof. In the present invention a defective panel or one damaged by severe weather can be replaced without incurring extensive wiring difficulty. An electrically operated valve element at the edge of the panels can selectively guide water from the roof either over the gutter thus effectively bypassing it, or into the gutter.

BACKGROUND OF THE INVENTION

It is well known that weather conditions as well as heat leaking from the interior of a dwelling can conspire to cause a buildup of ice at the edge of a roof forming an ice dam. Once this ice dam is formed, further melting of snow and/or ice from higher portions of a peaked roof will cause water to flow down to this area. The flow of this water is partially blocked such that it can flow underneath the shingles, wet the roof decking and penetrate into the interior of the dwelling causing water damage inside and often saturating the wall and ceiling insulation.

One popular solution that is partially successful is the use of heat cables attached to the edge of the roof in a zig-zag pattern. Unfortunately, often ice still forms in the "v's" of the cable and ice dams just form further up on the roof with their attendant problems. They also detract from the appearance of the dwelling and are often removed in the warmer months incurring much effort of a seasonal nature. Furthermore, if the dwelling has gutters, additional heat tapes or cables are used inside the gutters and downspouts to keep these operational and prevent ice buildup within which could damage the gutters. This necessitates more energy use. Many home builders advise against the use of gutters in regions susceptible to ice dam formation. In some cases, however, gutters are desired or needed to convey roof water away from the base of the dwelling in wet seasons.

Much prior art has been devoted to the solution of the ice dam problem. Eisenhoefer U.S. Pat. No. 4,401,880 describes a device to melt a channel in the snow and ice at the roof edge. It has a hinged extension that extends over the gutter. While it is useful to melt a narrow channel at intervals along the roof edge, the apparatus detracts from appearance and is not effective at routing ice melt water from falling into the gutter. Also, being a narrow channel device, it offers no waterproofing protection to the roof edge. Tourangeau U.S. Pat. No. 5,391,858 describes an ice dam melting system in the form of a hollow heat cell panel which replaces the last course of shingles at the edge of the roof. Being a narrow strip of heated panel at the edge, it does not offer much protection to shingles farther up where the ice dam may move. Integral with the "heat cell" is a drip edge heating element leading into the gutter and a heating element inside the gutter. Taouil U.S. Pat. No. 4,769,526 shows a metal roof de-icing panel which also replaces one or more lower courses of shingles. It incorporates a perforated metal portion extending over the gutter to prevent debris from clogging the gutter; it does not prevent melt water from flowing into it however.

OBJECTS OF THE INVENTION

It is the object of the present invention to provide the homeowner with an apparatus including electrically heated panels that can be easily installed over existing roofing to prevent ice dam buildup at the edge.

It is a further object that these panels be interconnected to eliminate the need for extensive wiring on the roof and to permit easy replacement of a single panel in case of damage.

It is a further object to provide an aesthetically pleasing solution to the ice dam problem that will permit the year round deployment of these roof panels.

It is a further object to provide panels that can be used with gutters such that the gutter can be bypassed for the winter season thereby preventing ice damage to it without resorting to using heat tapes inside the gutters and downspouts.

It is a further object that the panels can be electrically altered to permit rain water to flow into the gutter during seasons not subject to ice dam formation.

It is a further object that the valve operation which is performed seasonally proceed from panel to panel sequentially to limit the peak current required by the valve operating mechanism thereby reducing the size and cost of the power supply.

It is a further object to provide heating panels that act as water diffusers at the roof edge for those installations where gutters are not installed.

SUMMARY OF THE INVENTION

In keeping with these objects and others which may become apparent, the present invention includes roof heating panels which are approximately 3 ft. (91 cm) wide by 3 ft. (91 cm) tall and one inch (25 cm) thick of a painted aluminum sheet metal construction. They have flexible heaters within, of the area (sheet) variety, consisting of a substrate such as mylar with etched foil elements or neoprene rubber with imbedded resistance wire or etched foil elements. The edge of the panels have perforations which can be selectively blocked by an electrically operated valve element thereby bypassing the gutter. The panels plug into each other for both the high voltage heating supply and the low voltage valve operator supply. Optionally, the valve operating mechanism can be eliminated for those installations for which no gutters are used; the valve would then be placed permanently in the open position.

BRIEF DESCRIPTION OF THE DRAWINGS

The present invention can best be understood in conjunction with the accompanying drawings, in which.

DETAILED DESCRIPTION OF THE PREFERRED EMBODIMENT

Figure 1:
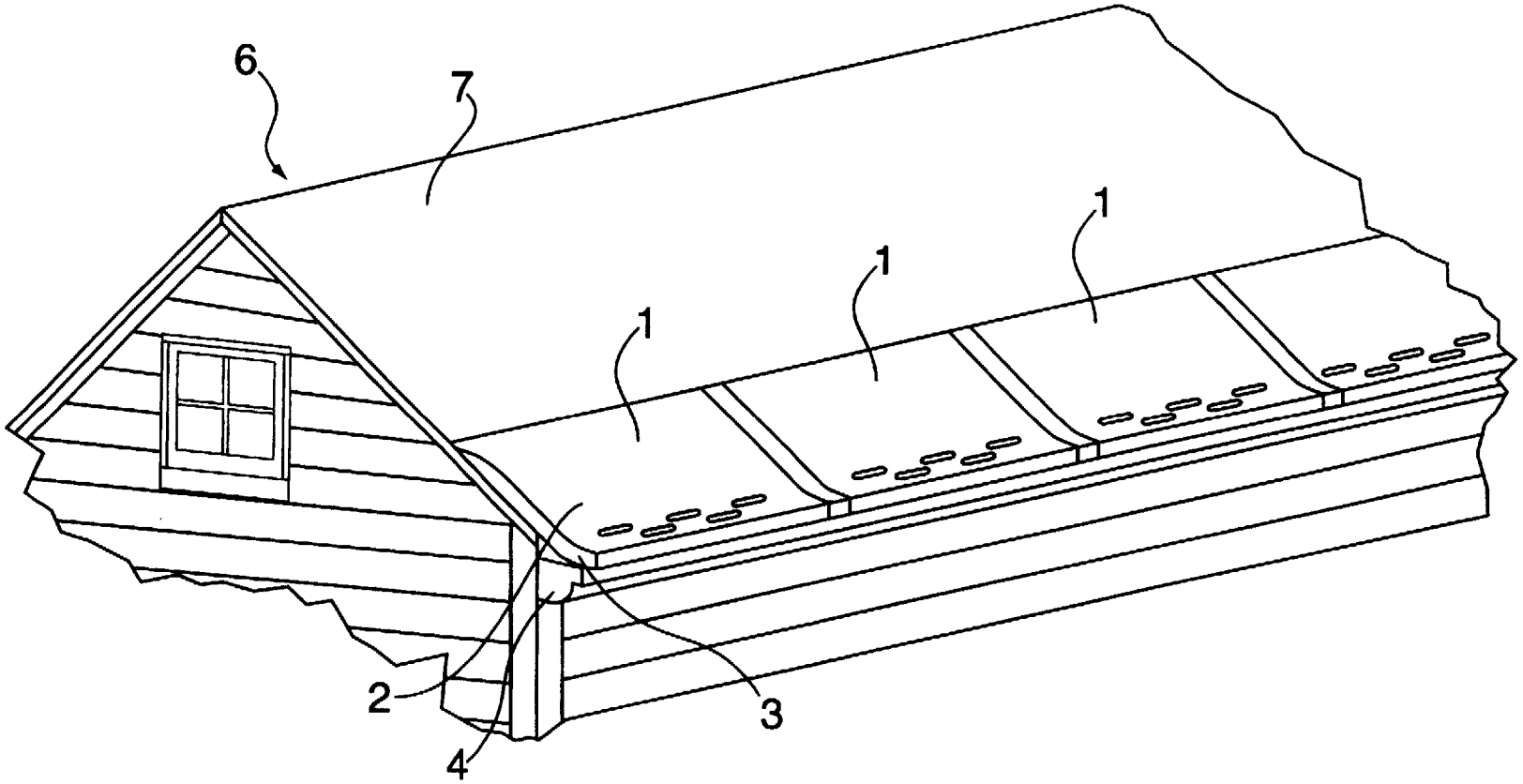
FIG. 1 is a perspective view of rooftop section with panels of the present invention.

FIG. 1 shows a detail of a typical house 6 with a peaked roof 7. The heating panels 1 of the present invention are placed at the edge of roof 7 with panel edge 3 of panel 1 extending beyond the edge of the roof 7 to cover the gutter 4. The portion of panels 1 above the gutter 4 has elongated perforations 2.

Figure 2:
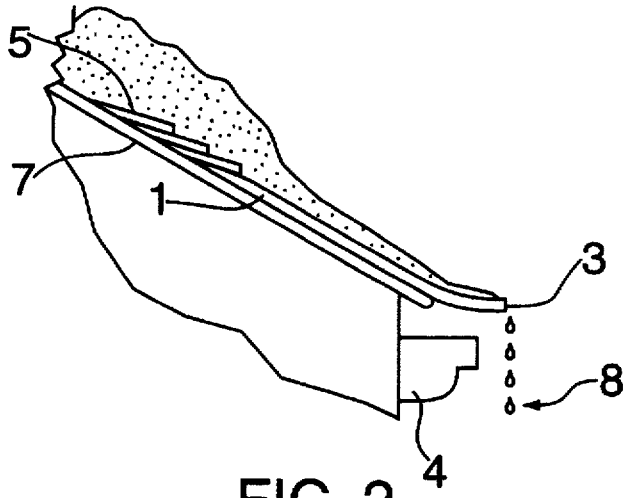
FIG. 2 is a detail side elevational view of a panel as in FIG. 1 showing snow melting with the gutter bypassed in a winter environment.
Figure 3:
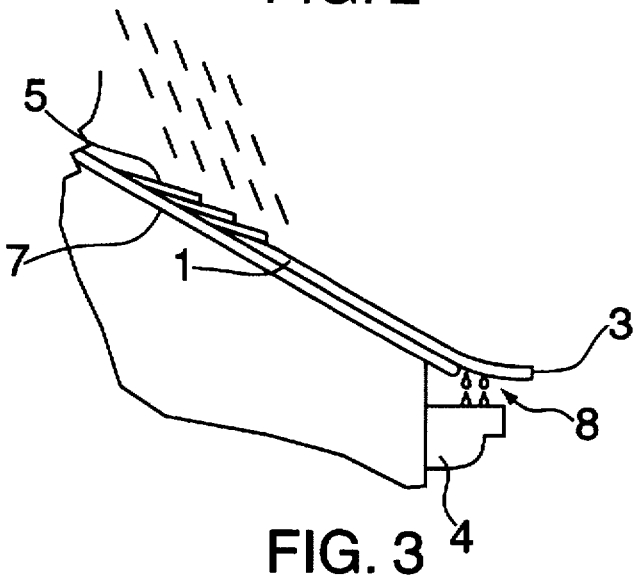
FIG. 3 is a detail side elevational view of a panel as in FIG. 1, showing rain runoff guided into gutter in a summer environment.
Figure 4:
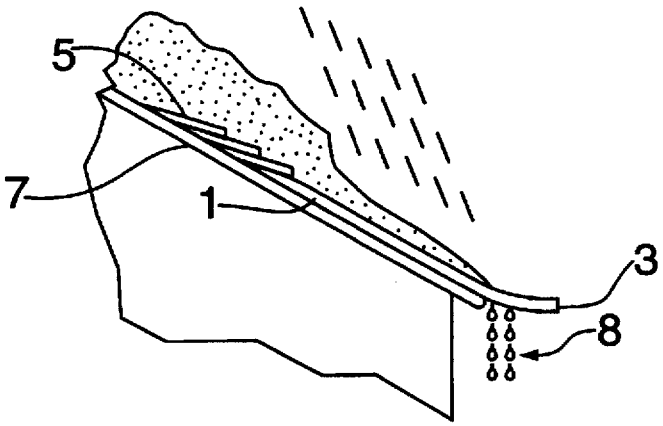
FIG. 4 is a detail side elevational view of a panel as in FIG. 1, showing a no-gutter installation.

FIG. 2 shows a winter scene with snow being melted by heating panels 1 and the melted water runoff 8 dripping over edge 3 of heating panels 1. In this winter application, the gutter 4 is bypassed by the dripping water 8, and elongated perforations 2 are blocked by a valve element. FIG. 3 shows a summer scene with rain falling on roof 7. The roof runoff 8 drips through elongated perforations 2 into gutter 4, because the valve element has been moved so that it no longer blocks elongated perforations 2. FIG. 4 shows an installation for a roof without gutters. FIG. 4 represents either a winter or summer scene since the perforations 2 are always open and runoff 8 drips through elongated perforations 2 in either season.

FIGS. 2, 3, and 4 show shingles 5 of roof 7. However, no shingles 5 are shown underneath panel 1 in the detail views of FIGS. 2, 3 and 4. In new construction, this would be the manner of installation; however, for existing construction, heating panels 1 can be installed over shingles 5.

Figure 5:
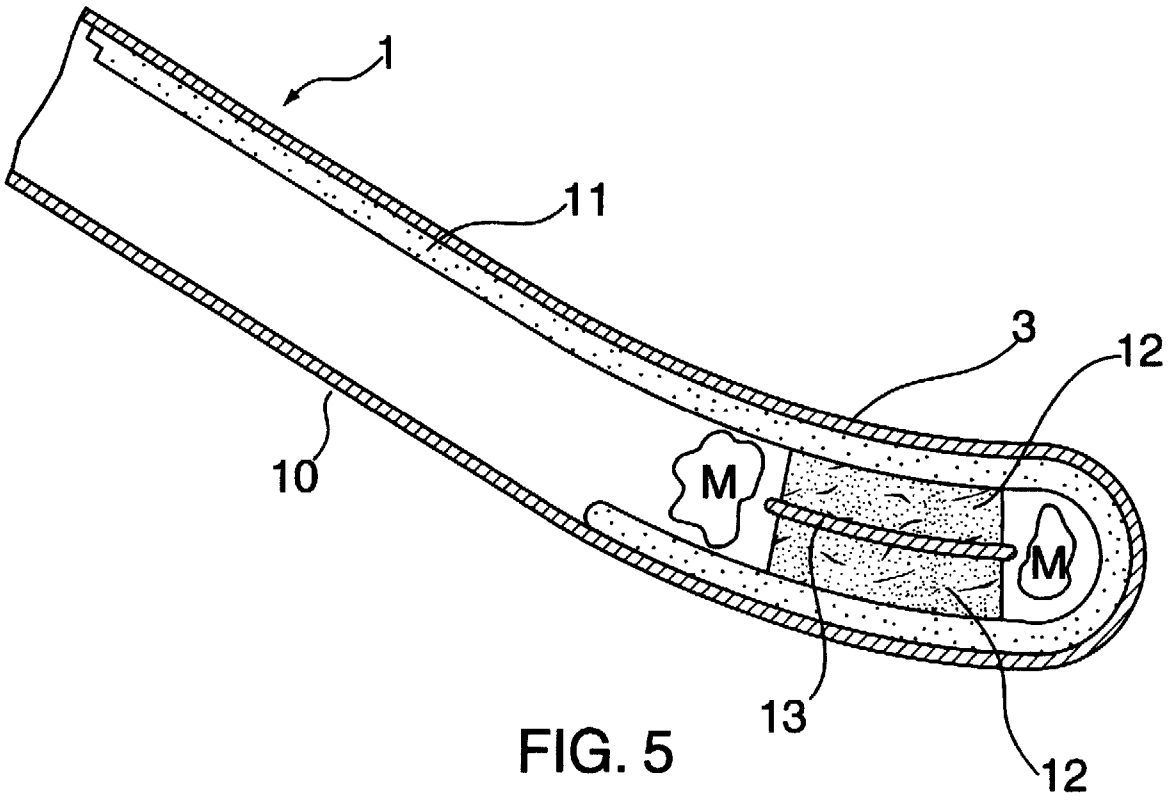
FIG. 5 is a side edge elevational cross section elevational view, showing the construction of a panel as in FIG. 1.
Figure 10:
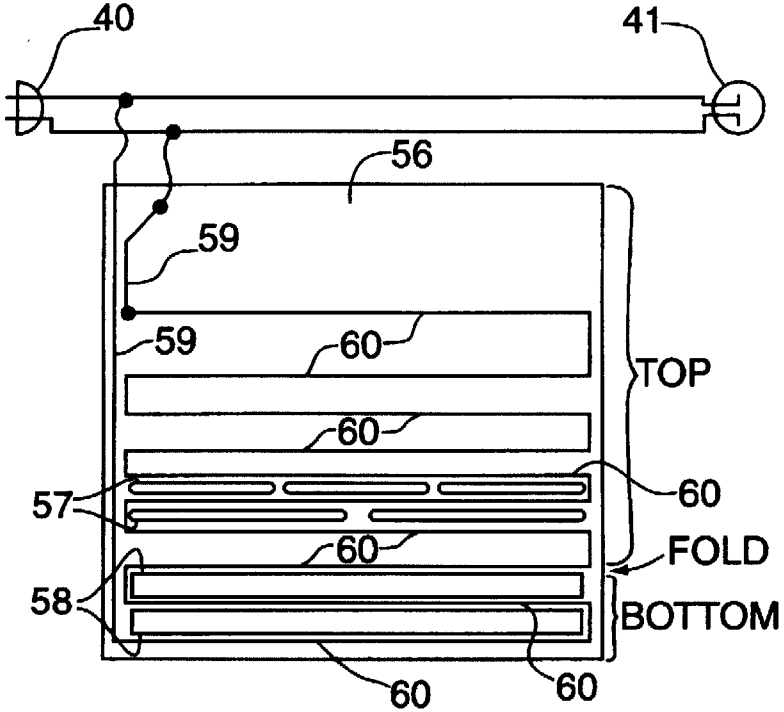
FIG. 10 is a top plan view of a flexible heater, showing cutouts and heating elements, for the panel as in FIG. 1.

FIG. 5 shows an enlarged detail of the curved edge 3 of heating panel 1. Outer layer 10, which covers both the top and bottom of panel 1, is preferably a painted aluminum panel 0.032" (0.81 mm) thick, such as that manufactured by Alumax Fabricated Products, Inc. Next inner heating element layer 11 is adhesively bonded to the inner surface of outer layer 10. Furthermore, inner layer 11 acts as the flexible heating element for heating panel 1, with an insulating substrate, such as mylar or neoprene, with embedded resistive heat traces. Elastomeric valve seals 12 are flexible seals and are bonded to inner heating element layer 11. Valve element 13 is preferably a metallic or plastic shutter which can be moved left or right by mechanisms M shown schematically. Lower surface 10 of heating panel 1 includes elongated perforations 2 previously shown in FIG. 1 on the top surface in the vicinity of elastomeric valve seals 12, which have elongated openings in positional registration with elongated perforations, 2. Outer layer 10 includes openings 53 under elastomeric valve seals 12 on the bottom as well, as will be more evident in FIG. 9. Inner heating element layer 11 is also perforated, as is shown in FIG. 10. Valve element 13 has elongated perforations that can be shifted into registration with those of elastomeric valve seal 12, or can be shifted in the opposite direction to block those perforations in elastomeric valve seal 12, thereby functioning as a valve element. Preferably the total valve movement is under 1 inch (25 mm).

Figure 6A:
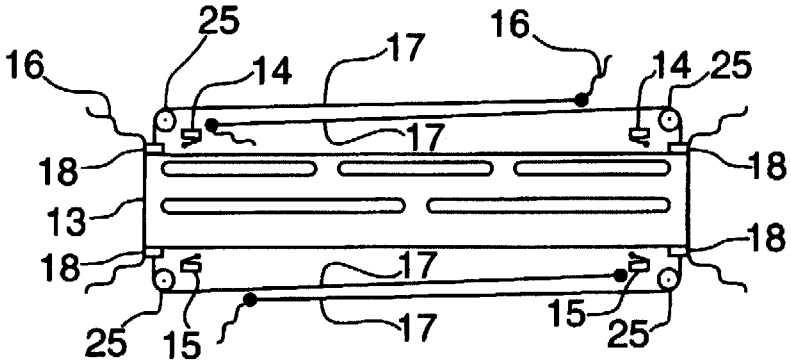
FIG. 6A is a close up view of shape memory wire actuators for the panel as in FIG. 1.

FIG. 6A–6D show a variety of mechanisms by which valve element 13, such as a movable shutter, can be urged into registration or blocking configuration relative to elastomeric valve seals 12. For example, FIG. 6A shows the use of shape memory wires 17 as actuators. Each shape memory wire 17 contracts by about 3 to 7% when its temperature exceeds a threshold temperature, such as 90 degrees C. Since it is made of a resistance alloy, memory wire 17 can be heated by passing current through it via flexible leads 16. When memory wire 17 contracts, it pulls valve element shutter 13 up or down, depending on which memory wire 17 is heated, by insulating attachment 18 over pulley 25. The distal ends of memory wires 17 are anchored. A commercial grade of such memory wire 17 is available under the brand name Flexinol from Dynalloy, Inc. of Irvine, Calif. As also shown in FIG. 6A, switches 14 and 15 are limit switches which cut off the current to the actuators when the appropriate valve transition has been completed. Switches 14 and 15 are preferably waterproof snap action switches with three connections: C (common), NC (normally closed), and NO (normally open). A series DC2 from Cherry Electrical Products of Waukegan, Ill. is a typical example of this type.

Figure 6B:
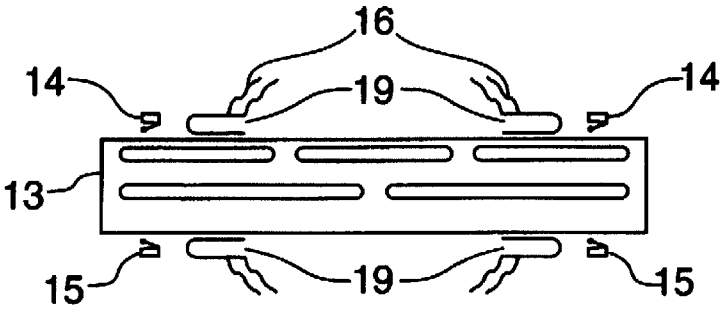
FIG. 6B is a close up view of bimetallic actuators for the panel as in FIG. 1.

FIG. 6B shows the use of four bimetallic actuators 19 to move the shutter appropriately. These "U" shaped bimetallic strips are heated by resistance wire wrapped around them such that they tend to straighten out i.e., the "U" opens up, thereby pushing the adjacent edge of value element 13, such as a movable shutter.

Figure 6C:
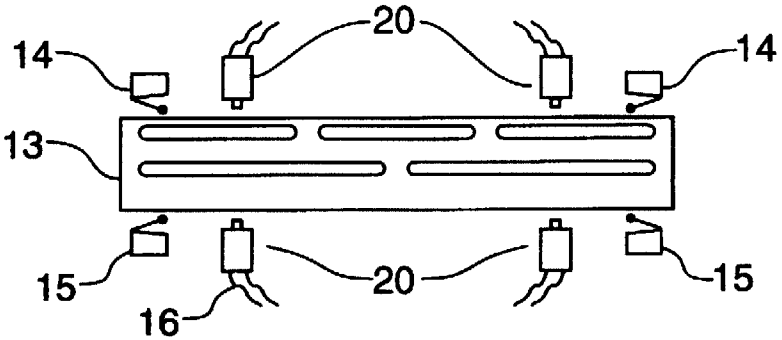
FIG. 6C is a close up view of solenoid or "TCAM" actuators for the panel as in FIG. 1.

FIG. 6C shows the use of packaged linear actuators 20 which may represent solenoids, voice coil actuators or a thermally activated solid state hydraulic actuator (TCAM). In each case, the actuator 20 consists of a housing with a plunger that advances, thereby pushing the adjacent edge of valve element 13, such as a shutter, when electrically activated. A typical TCAM device is from TCAM Technologies, Inc. of Eastlake, Ohio which has size advantages over the solenoid or voice coil actuators of equivalent force output, which is an advantage for the current application.

Figure 6D:
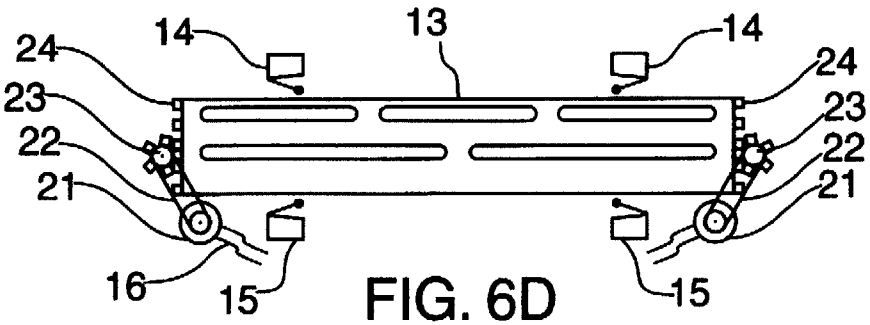
FIG. 6D is a close up view of bi-directional motor actuators for the panel as in FIG. 1.

FIG. 6D shows a further actuator based on the use of two reversible DC motors 21 driving a pinion gear 22 through belt drive 22. Pinion gear 22 engages gear rack 24 attached to either end of shutter 13 thereby moving it in either direction. As will be known in the art, a lead screw and nut mechanism can be used in lieu of the belt and rack and pinion mechanism.

The preferred embodiment uses either the shape memory wire actuators 17 or the bimetallic actuators 19 due to size and cost constraints.

Figure 7A:
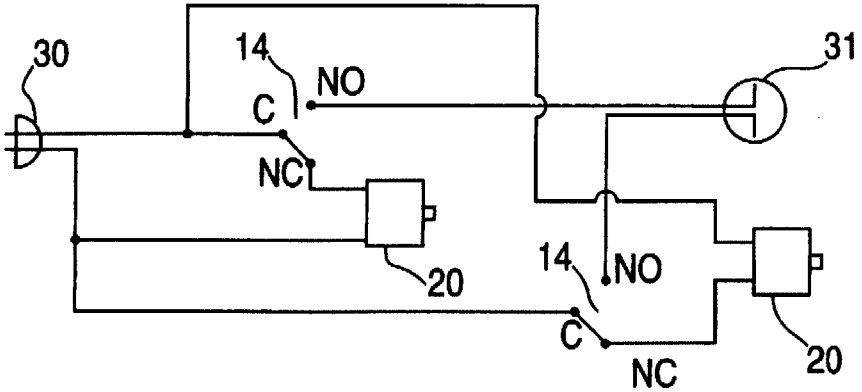
FIG. 7A is an actuator schematic diagram of a "Winter" circuit for linear actuators of the panel in FIG. 1.

FIG. 7A shows the wiring diagram applicable to any of the actuators above except for the bidirectional motors. Although packaged linear actuators 20 are shown, bimetallic actuators 19 or shape memory wire actuators 17 can be substituted in this wiring diagram. Power source plug 30 is provided to supply low voltage AC or DC to the circuit. The circuit shown is for only one "side" of valve element 13, such as a shutter, i.e. the for "winter" circuit, which handles two actuator units 20. An identical circuit with its own separate power supply plug handles the actuation for the opposite direction, i.e. for the "summer" circuit. When power is supplied through plug 30, both actuators 20 start operating as current is supplied through their respective limit switches 14 using the circuit from "C" to "NC". At that time, socket 31, which supplies current to the next panel in sequence, is not energized since both limit switches 14 interrupt this path. Actuators 20 keep operating until their respective limit switches 14 snap to the opposite configuration ("C" to "NO") thereby interrupting current to the actuator 20, while completing the circuit to the output socket 31. In this way, even if the actuator movement is not exactly synchronized, each actuator 20 is supplied current until its own separate limit switch 14 detects that the valve element 13, such as a shutter, is in its proper position at its own end. This is important when dealing with a long narrow shutter, such as valve element 13, which is squeezed between elastomeric seals. By the method of putting limit switches 14 in opposite legs of the current supply for each of the two actuators 20, the output socket 31 is not energized until both of the actuators have reached the end of their travel. For this application, actuation time or delay is of little consequence. For example, it can take milliseconds or minutes, since the operation is done only once each year i.e. summer or winter. With many heating panels 1 for a typical house installation, the current requirement of about 2 to 8 amperes per panel, rapidly adds up if all heating panels 1 were operated simultaneously. With the sequential scheme illustrated by the wiring diagram in FIG. 7A, only one pair of actuators is activated at one time for an entire string of interconnected panels. The power supply for the actuators can be sized for this load as can the gauge of the wires. This can typically be a saving of 14:1 in current rating.

Figure 7B:
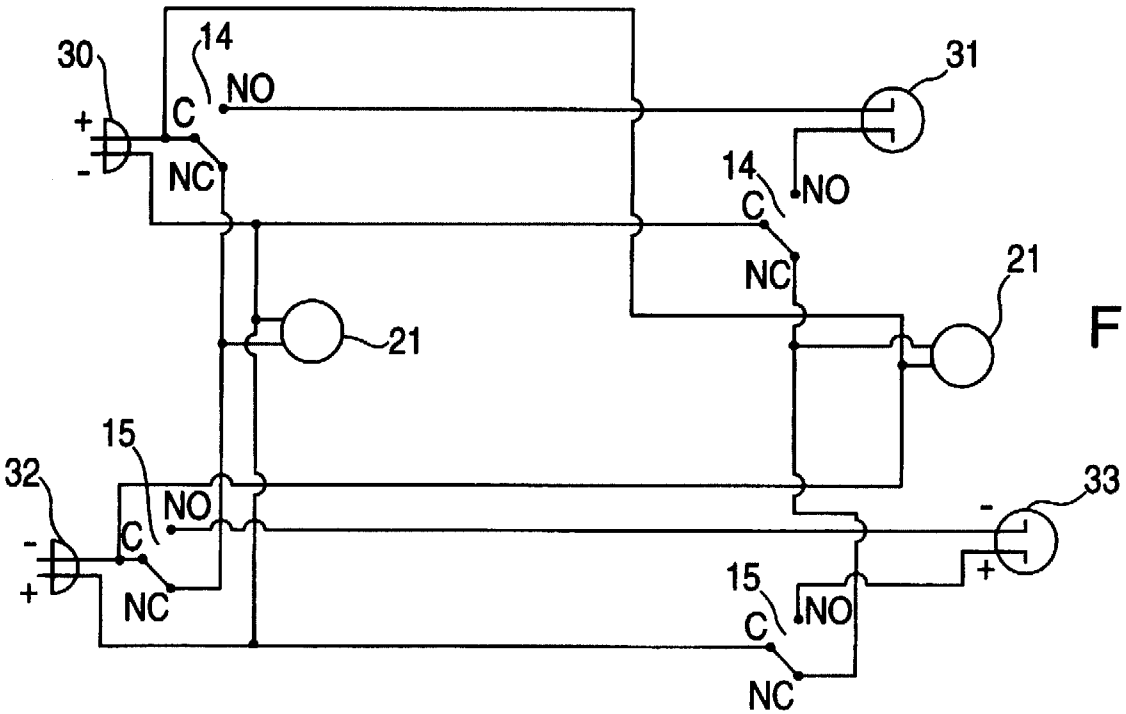
FIG. 7B is an actuator schematic diagram of the bi-directional motor circuit for the panel as in FIG. 1.

While FIG. 7A shows devices, such as actuators, that are either AC or DC, they are inherently insensitive to polarity. In contrast, FIG. 7B shows a circuit to drive reversible DC motors 21 as depicted in FIG. 6D. This circuit of FIG. 7B is polarity sensitive, and it is essential that plugs 30, 32 and sockets 31, 33 be of a polarized variety that maintain connection integrity relative to polarity. Plug 30 is energized to move valve element 13, such as a shutter, to the winter position. Plug 32 is energized to move valve element 13, such as a shutter, in the opposite position to the summer position. Motors 21 are of the permanent magnet field type, which reverse direction when the polarity of the applied voltage is reversed. Similar in operation to the above circuit, output sockets 31, 33 are energized only after both motors 21 have been deenergized by their respective limit switches 14 or 15. In FIG. 7B, only two actuators, motors 21, are used to operate valve element 13, such as a shutter. In all other illustrations, four separate actuators are required. With the proper mechanical linkages, a single actuator can operate valve element 13, such as a shutter.

Figure 8A:
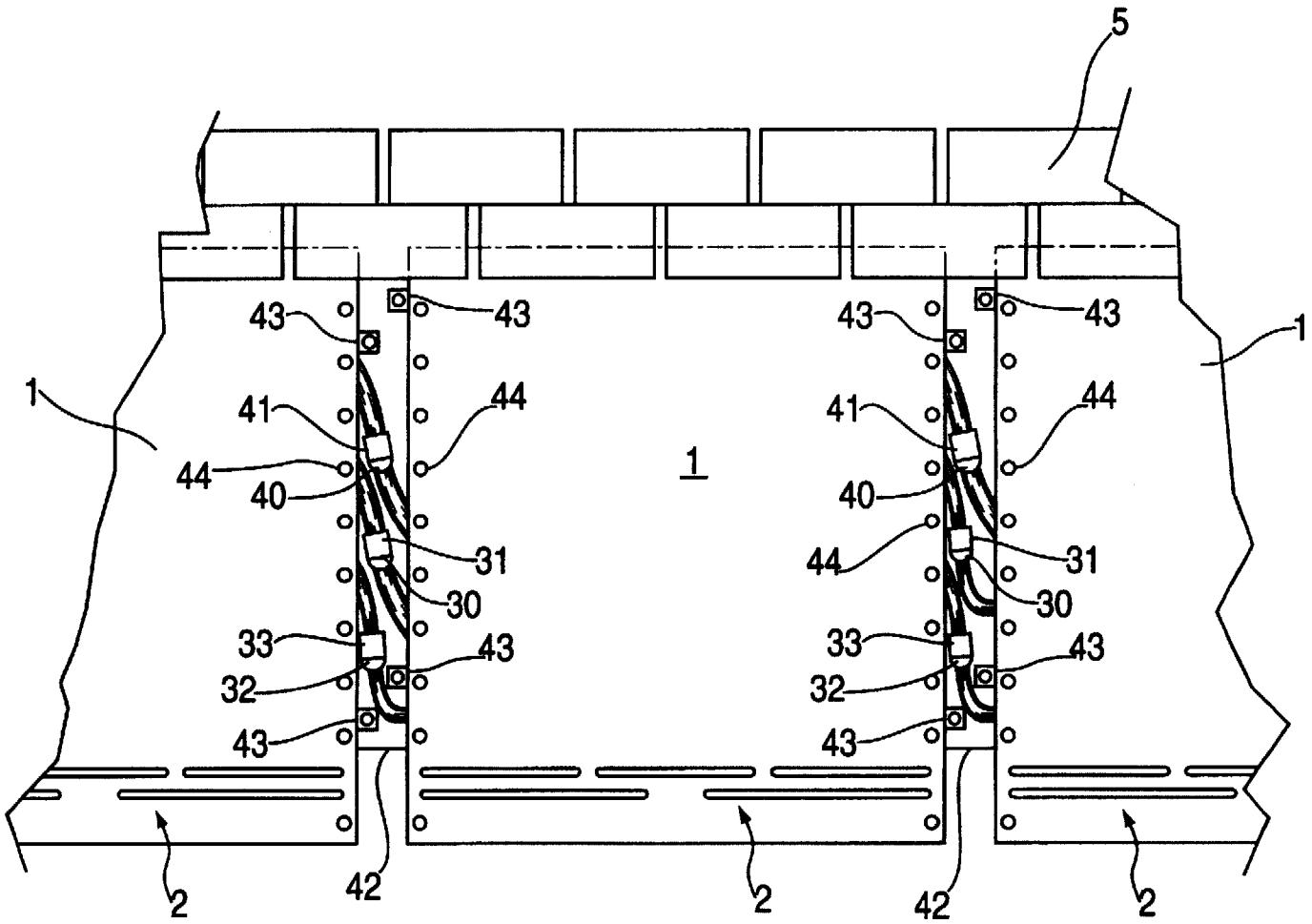
FIG. 8A–8B are top plan views of panels with interconnects.
Figure 8B:
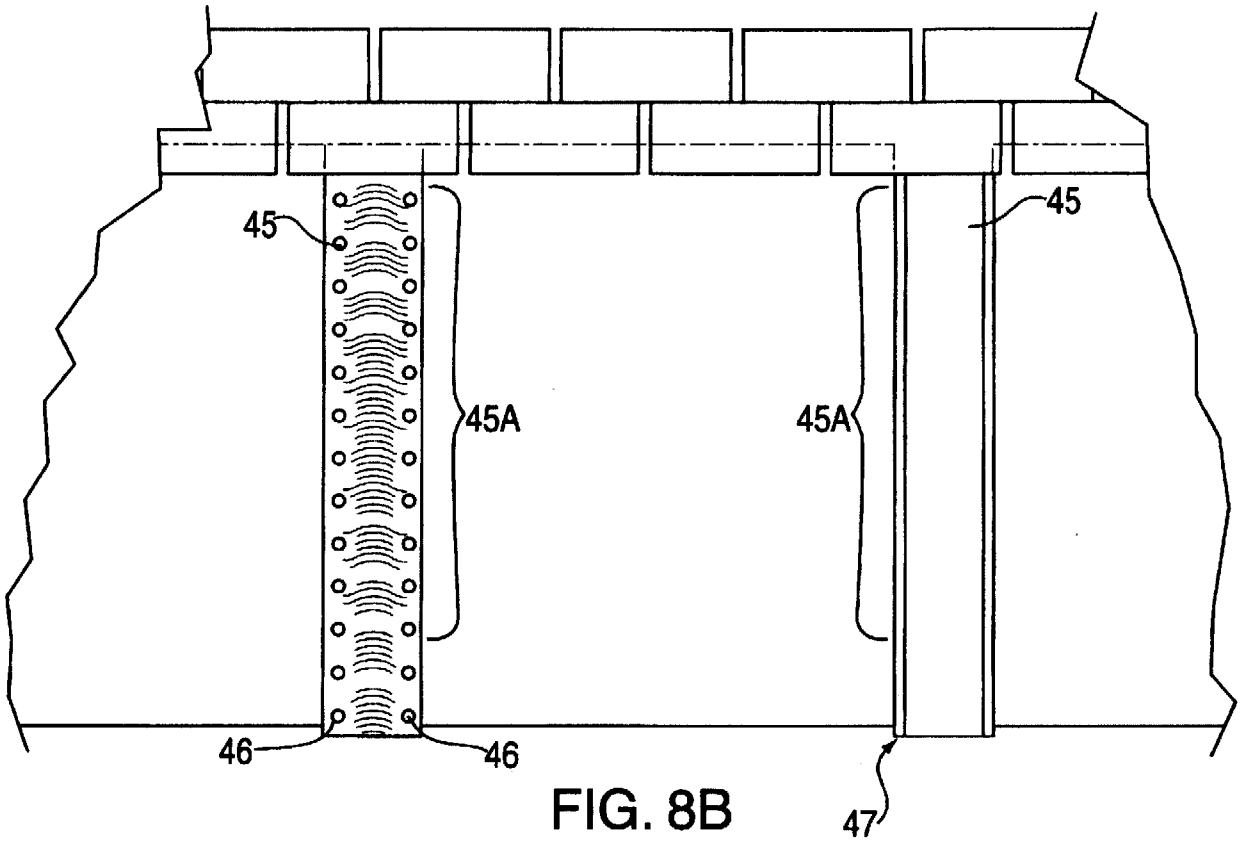
Figure 8D:
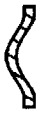
FIG. 8D is a side cross sectional view of the interconnect strip as in FIG. 8C.
Figure 8C:
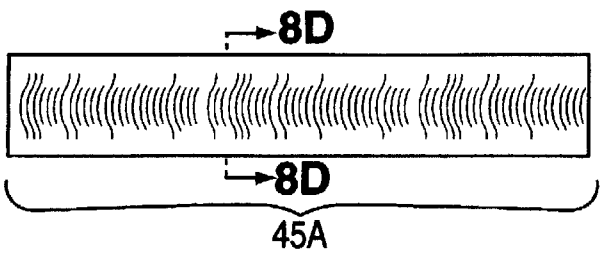
FIG. 8C is a top plan view of an interconnect strip for the panels as in FIG. 1.

FIG. 8A shows a top plan view of heating panel 1 between two adjacent heating panels 1. A connecting strip 45 which attaches adjacent heating panels 1 and encloses the connector space between them is shown in FIG. 8B, 8C and 8D. Such a connecting strip 45 may be simply a sheet metal or plastic strip which may be crowned in the center region 45*a*, as shown in cross section along lines X—X, to afford extra height for the power connector. Connection strip 45 is attached by fasteners 46, such as screws, or slides into grooves 47. Holes 44 for screwing a connecting strip in place are shown on the edge of heating panels 1, which panels 1 are attached to the roof 7 with mounting tabs 43. Power socket 41 and plug 40 are shown connecting the power line from each panel 1 to another panel 1. These are typically water/dust-tight connectors such as the NEMA 6–20 types as supplied by several manufacturers. The smaller wires and connectors are for operating the "summer/winter" gutter exclusion valve element 13. If this feature is not used, these elements are eliminated. Socket 31 is connected to a long "pigtail" while plug 30 is connected to a short one; this pair constitutes the "winter" circuit. Socket 33 and plug 32 are the "summer" circuit. Because of the different length of pigtails on these sockets and plugs, it is not possible to mistakenly plug the summer into the winter circuit or vice-versa. These low voltage connectors are water resistant polarized types often used in the automotive industry. The edge of the roof 7 is denoted by reference numeral 42. The top edge of the panels is overlaid by a course of shingles 5. Non hardening mastic can be used to seal this edge.

Figure 9:
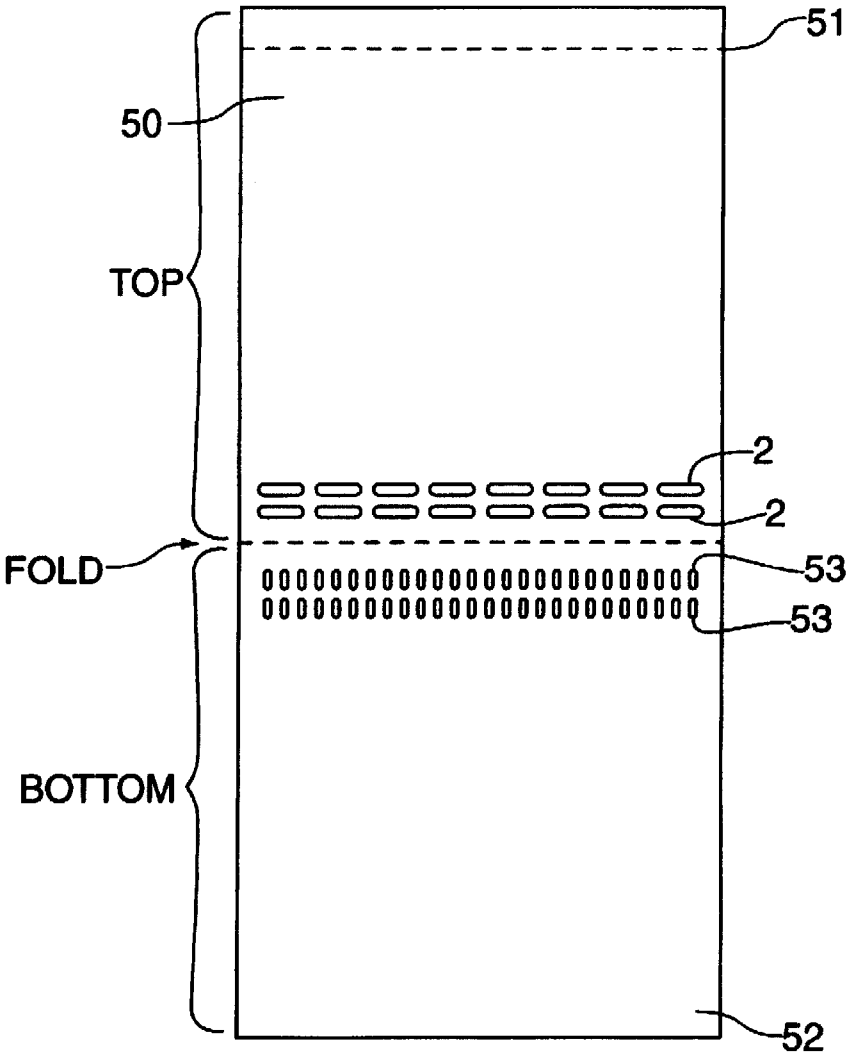
FIG. 9 is a top plan view of a sheet metal pattern prior to assembly to a panel as in FIG. 1.
Figure 12:
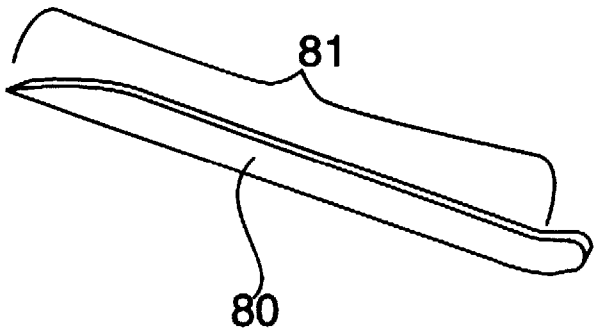
FIG. 12 is a perspective view of a side piece for a heating panel as in FIG. 1.

FIG. 9 shows panel 50, such as sheet metal, as it is perforated prior to assembly around side pieces 80 shown in FIG. 12 to form heating panel 1. The top elongated holes 2 and the series of short slits 53 on bottom surface of panel 50 allow roof water runoff 8 to flow through slits 53 on the edge of heating panel 1 if the edge valve element 13, such as a shutter, is in the open position. The configuration of slits 53 is designed to diffuse this flow of roof runoff 8. Bottom end 52 is attached to the underside of the top piece of heating panel 1 at line 51, thereby leaving a tab for insertion under a course of shingles 5.

FIG. 10 shows a particular heating element 56, which is adhesively bonded to an inside surface of the sheet metal panel 50. Heat traces 60 are shown as a series circuit with the heat concentrated at the bottom end of panel 50. Traces 60 adjacent to the elongated holes 57 are attached in positional registration with elongated perforations 2 in panel 50, similar to heating panel 1. Also, traces 60 are adjacent to cutouts 58 which are in positional registration with slits 53 in panel 50. A parallel/series trace connection with convoluted trace patterns can be easily accomplished with etched foil traces to permit much better control of heat distribution than the simple series layout illustrated in FIG. 10.

The heat is concentrated at the bottom of the panel 50 so that if small ice dams start forming further up, the panel material will protect the roof from damage.

Side supports 80 shown in FIG. 12 are cut from suitable rigid material such as closed cell foamed polystyrene. Panel 50 is attached to top edge 81 permanently by using a double-sided high bond tape such as that supplied by 3M Corporation. The edge and lower portion can be attached by screws to permit disassembly for repair if required.

Figure 11:
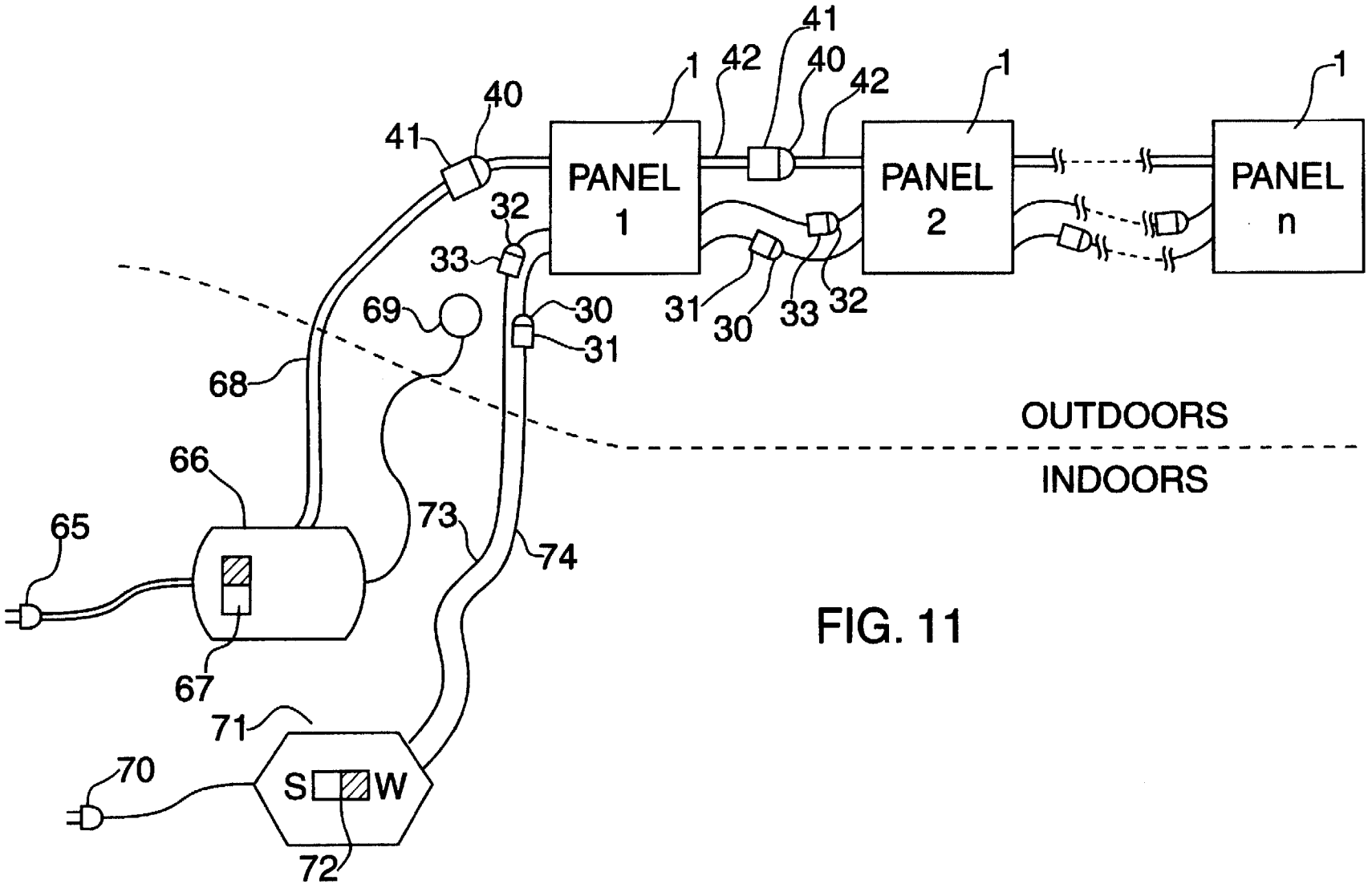
FIG. 11 is a system wiring diagram for the panels as in FIG. 1.

FIG. 11 shows a wiring diagram of a series of interconnected panels 1. Plug 65 connects to 115 VAC or preferably 230 VAC supply. It is preferably hard wired to its own circuit in a panel box with its own circuit breaker. Each heating panel 1 draws from 60 to 150 watts as per design for different regions. The current draw for the entire string of heating panels 1 is substantial and is half as large at 230 VAC as for a 115 VAC supply. A main switch 67 for the heating circuit is shown on heating controller 66 which is typical of those designed to control heat cables. A snow-ice detector 69 as well as a temperature detector are used in conjunction with timers in controllers 66 such as the Model AS-6 from Easy Heat, Inc. of New Carlisle, Ind. The heating supply cable 42 is strung through each heating panel 1 and connected through sockets 41 and plugs 40. Plug 70 provides 115 VAC power to the summer/winter valve feature if it is installed. Power supply 71 may be a dc power supply for reversible DC motor actuators, or simply a step down transformer for any of the thermally activated actuators. Switch 72 is the summer/winter switch. Reference numerals 73 and 74 represent two conductor cables supplying the summer or winter activation current to heating panels 1 through sockets 31 and 33 and plugs 30 and 32.

Figure 13:
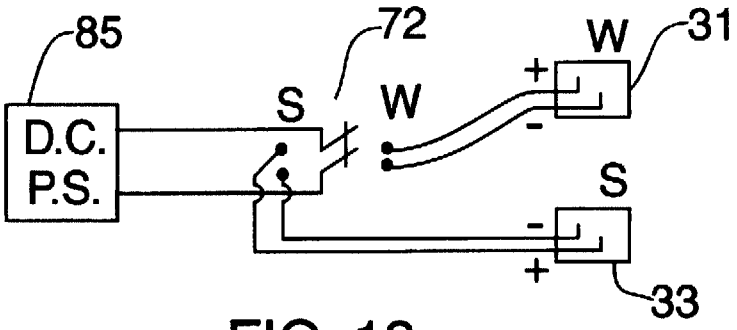
FIG. 13 is a D.C. switching detail diagram for the panels as in FIG. 1.

FIG. 13 shows a detail of the circuit for use with reversible DC motors including DC power supply 85 and the polarized sockets 31 and 33.

Figure 14:
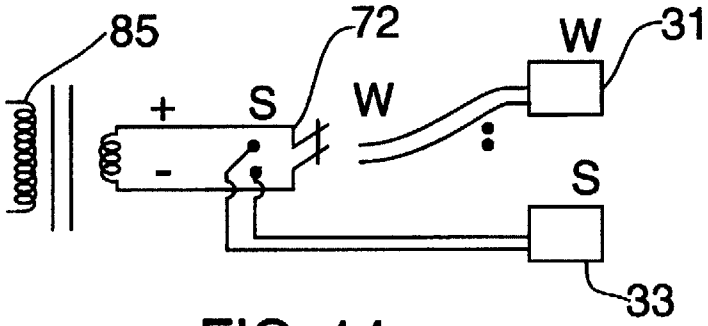
FIG. 14 is an A.C. switching detail diagram for the panels as in FIG. 1.

FIG. 14 shows a detail of a double-pole-double-throw (DPDT) switch circuit for AC operation from a step down transformer 90.

In summary, modular roofing heating panels 1, which remove snow and ice from the edge of a roof 7, are interconnected, to allow replacement without incurring extensive wiring difficulty. Electrically operated slidable valve element 13 located at a lower edge of the panels 1, selectively guides water runoff from the roof either over a gutter 4 in a cold winter application, thus effectively bypassing it, or into the gutter 4 in a summer drainage application.

Other modifications may be made to the present invention, without departing from the scope of the invention, as noted in the appended claims.

I claim:

1. A roof ice build up prevention apparatus comprising:

at least one heating panel that is installed over existing roofing to prevent ice dam buildup at the edge, said heating panel being placed over a roof, said heating panel having a heating element therein, said heating panel having a movable valve in positional register with at least one perforation in said heating panel, said movable valve movable from a closed position closing said at least one perforation to prevent flow of water therethrough to an open position opening said at least one perforation to permit flow of water therethrough.

2. The apparatus as in claim 1 further comprising a plurality of said heating panels, each said heating panel interconnected with at least one other heating panel of said plurality of heating panels.

3. The apparatus as in claim 1, wherein said heating element within said heating panel comprises a flexible heater, said heating element comprising a substrate having imbedded resistance elements therein.

4. The apparatus as in claim 1, wherein said at least one perforation is selectively blocked by said movable valve for bypassing a gutter of the roof.

5. The apparatus as in claim 1, wherein each said heating panel plugs into another heating panel for both high voltage heating supply and a low voltage valve operator supply.

6. The apparatus as in claim 1 wherein said heating panel is placed at the edge of the roof with an edge of said heating panel extending beyond the edge of the roof to cover the gutter.

7. The apparatus as in claim 1 wherein said at least one perforation is elongated.

8. The apparatus as in claim 1 wherein said heating panel includes an outer layer covering both the top and bottom of said heating panel, and an inner next layer adhesively bonded to an inner surface of said heating panel.

9. The apparatus as in claim 1 wherein said heating element is a flexible insulating substrate having embedded resistive heat traces, said heating element having flexible elastometric valve seals bonded to said heating element.

10. The apparatus as in claim 1 wherein said movable valve comprises a movable shutter laterally movable over said perforations.

11. The apparatus as in claim 1 wherein said heating element is perforated.

12. The apparatus as in claim 1 wherein said valve element is urged into and out of positional registration with said at least one perforation of said heating panel by an actuator.

13. The apparatus as in claim 12 wherein said actuator comprises at least one shape memory wire contractable when its temperature exceeds a predetermined threshold temperature, said actuator urging said valve element to move laterally.

14. The apparatus as in claim 13 wherein said activator further includes at least one limit switch which cuts off current to said actuator when said movable valve has moved a predetermined distance.

15. The apparatus as in claim 13 wherein said actuator is a bimetallic actuator, heated by a resistance wire wrapped around said actuator wherein said activator straightens thereby pushing an adjacent edge of said movable valve.

16. The apparatus as in claim 13 wherein said actuator includes a housing with a plunger that advances and pushes an adjacent edge of said movable valve when electrically activated.

17. The apparatus as in claim 13 wherein said actuator includes a pair of reversible DC motors driving a pinion gear through a belt drive, said pinion gear engaging a gear rack attached to an end of said movable valve, thereby moving said movable valve in either direction.

18. The apparatus as in claim 2 wherein between two adjacent heating panels there is provided a connecting strip which attaches adjacent panels and encloses a connector space between said heating panels.

19. The apparatus as in claim 2 wherein two adjacent heating panels of said plurality of heating panels are electrically connected by a power line interrupted by water/dust-tight low voltage polarized connectors.

20. The apparatus as in claim 19, further comprising a plurality of heat traces in a series circuit, wherein heat is concentrated at a bottom end of said heating panel, said heat traces located adjacent to said elongated perforations attached in registration with said elongated perforations.

* * * * *